United States Patent [19]

Britton

[11] 4,227,118

[45] Oct. 7, 1980

[54] CIRCUITS FOR OPERATING ELECTRIC DISCHARGE LAMPS

[75] Inventor: John Britton, West Kingsdown, England

[73] Assignee: The General Electric Company Limited, London, England

[21] Appl. No.: 961,651

[22] Filed: Nov. 17, 1978

[30] Foreign Application Priority Data

Dec. 1, 1977 [GB] United Kingdom ..... 50083/77

[51] Int. Cl.[2] ..... H05B 41/04; H05B 41/18

[52] U.S. Cl. ..... 315/101; 315/105; 315/106; 315/200 R; 315/240

[58] Field of Search ..... 315/99, 101, 105, 106, 315/200 R, 205, 208, 233, 240, 244, DIG. 5

[56] References Cited

U.S. PATENT DOCUMENTS 3,857,060 12/1974 Chermin ..... 315/99

3,978,368 8/1976 Tomura et al. ..... 315/101 X

FOREIGN PATENT DOCUMENTS 2435774 2/1976 Fed. Rep. of Germany ..... 315/240

*Primary Examiner*—Eugene R. LaRoche

*Attorney, Agent, or Firm*—Kirschstein, Kirschstein, Ottinger & Cobrin

[57] ABSTRACT

An electric discharge lamp circuit arrangement wherein rapid starting of the lamp is obtained by charging a ballast impedance capacitance via a unidirectional current conducting path in a sense such as to breakdown a voltage breakdown device in the control electrode lead of a controllable switching device connected with the lamp to provide a current path between the supply terminals comprising, in series, the capacitance, heating means for the lamp main electrodes and the switching device. On breakdown, the switching device temporarily conducts to complete the series path and cause a pulse of current to flow through the heating means, whereafter the capacitor recharges and a further current pulse is produced. The unidirectional current path may extend through the breakdown device or by-pass the breakdown device via a rectifier.

9 Claims, 7 Drawing Figures

CIRCUITS FOR OPERATING ELECTRIC DISCHARGE LAMPS

This invention relates to electric discharge lamp circuit arrangements.

The invention relates particularly to circuit arrangements for operating electric discharge lamps of the kind having a pair of main discharge electrodes at least one of which requires to be heated during starting e.g. fluorescent lamps.

A known such circuit arrangement comprises: a pair of terminals for connection to an alternating current supply; a ballast impedance connected between one of said terminals and one of the main electrodes of the lamp; a connection between the other of said terminals and the other of said main electrodes; a controllable switching device connected with the lamp to provide a current path between said terminals comprising, in series, said ballast impedance, heating means for at least one of the lamp main electrodes and said switching device; and means for controlling said switching device so as to supply current to the heating means during starting of the lamp.

It is an object of the present invention to provide an improved form of such a circuit arrangement which provides more rapid and reliable starting than hitherto.

According to the present invention an electric discharge lamp circuit arrangement comprises: a pair of terminals for connection to an alternating current supply; a ballast impedance comprising a capacitance connected between one of said terminals and one of a pair of main electrodes of the lamp; a connection between the other of said terminals and the other of said main electrodes; heating means for at least one of said main electrodes; a controllable switching device connected with the lamp to provide a current path between said pair of terminals comprising, in series, said capacitance, said heating means and said switching device; a voltage breakdown device connected between the control electrode and a main electrode of said switching device; and a unidirectional current conducting path connected in series with said capacitance between said terminals whereby said capacitance is charged in a sense such as to bias said breakdown device towards breakdown.

In one particular arrangement in accordance with the invention said unidirectional conducting path extends through said voltage breakdown device. In such an arrangement said unidirectional conducting path may further extend through a rectifier connected in series with said breakdown device.

In another particular arrangement in accordance with the invention said unidirectional conducting path extends through a rectifier connected between the main electrodes of said switching device. In such an arrangement the unidirectional conducting path preferably incorporates a further voltage breakdown device whose breakdown voltage is such that the unidirectional conducting path becomes inoperative when the lamp has struck.

The switching device is suitably a thyristor and the first-mentioned voltage breakdown device is suitably a zener diode.

The ballast impedance will normally include an inductance connected in series with said capacitance.

Several circuit arrangements in accordance with the invention will now be described by way of example with reference to the accompanying drawings in which.

Figure 1:
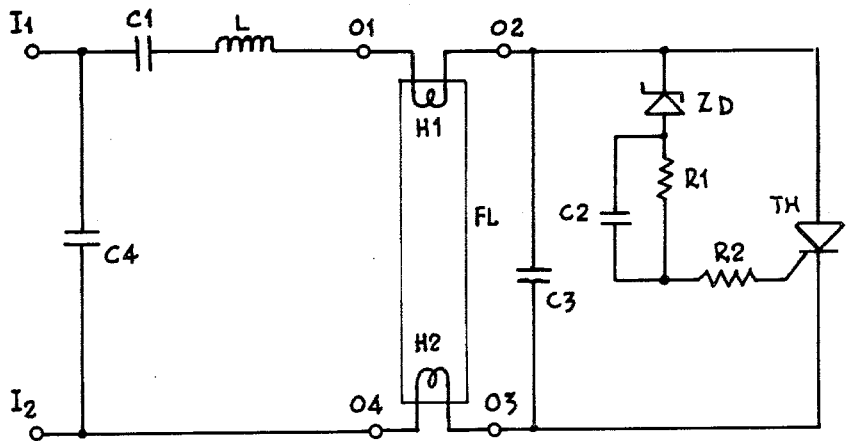
FIG. 1 is a schematic diagram of one circuit arrangement.

Referring to FIG. 1, the first arrangement includes a pair of input terminals I1 and I2 between which an alternating current supply is connected in operation, and two pairs of output terminals O1, O2 and O3, O4 between which directly heated electrodes H1 and H2 of a fluorescent lamp FL are respectively connected in operation.

Between the terminals I1 and O1 there is connected a ballast impedance comprising an inductor L and a capacitor C1 connected in series, the other input terminal being directly connected to the output terminal O4.

To provide a path for the supply of current from the supply to the electrodes H1 and H2 a thyristor TH is connected between terminals O2 and O3, the thyristor anode being connected to terminal O2. The thyristor TH is provided with a firing circuit comprising a zener diode ZD whose cathode is connected to the anode of the thyristor TH and whose anode is connected via series connected resistors R1 and R2 to the gate of the thyristor. A capacitor C2 is connected in parallel with resistor R1.

Two further capacitors C3 and C4 may be connected across terminals O2, O3 and terminals I1, I2, if desired, to provide transient protection.

The operation of the circuit with the terminals I1 and I2 connected respectively to the live and neutral terminals of the supply will now be described, the references to potentials being with respect to neutral.

When the supply is switched on, thereby to apply the supply voltage between terminals I1 and I2, the capacitor C1 starts to charge up via the unidirectional conducting path comprising electrode H2, the gate resistance of thyristor TH, components R1, R2 and C2, the diode ZD, electrode H1 and inductor L. The capacitor C1 and diode ZD thus operate in the manner of a voltage doubler. The circuit thus rapidly moves towards a condition in which the potential at terminal O2 swings between zero potential and a positive potential of twice the peak supply voltage.

Figure 2:
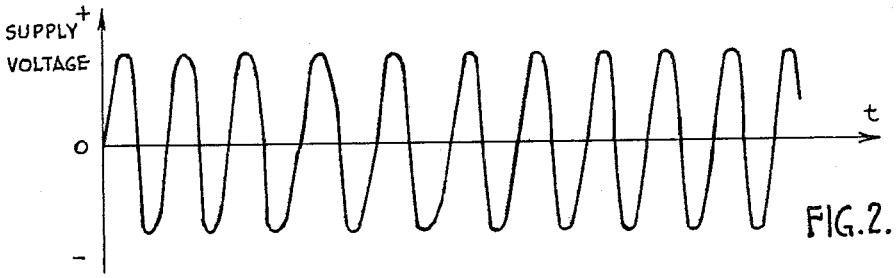
FIGS. 2, 3 and 4 are waveforms illustrating the operation of the circuit arrangement of FIG. 1.
Figure 3:
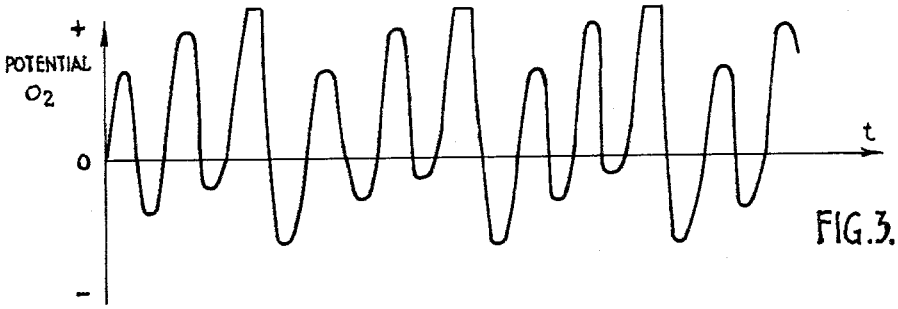

However, before the capacitor C1 charges sufficiently for this condition to be fully achieved the peak reverse potential across the zener diode ZD reaches a high enough value to cause the diode to break down. FIG. 3 shows the waveform of the potential of terminal O2 during this time, while FIG. 2 shows the supply voltage waveform.

Figure 4:
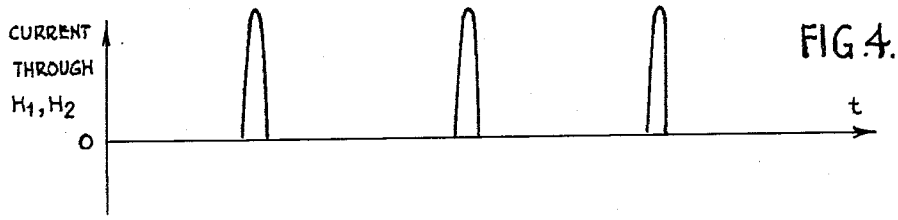

When the zener diode ZD breaks down the thyristor TH fires, and since at this time the thyristor is forward biassed by the potential difference between terminals O2 and O3, a large pulse of current flows through the electrodes H1 and H2, the pulse terminating when the thyristor becomes reverse biassed, as shown in FIG. 4. The capacitor C1 having discharged during the current pulse, then starts to re-charge via zener diode ZD producing a further current pulse when the diode ZD next breaks down.

Under these conditions the lamp FL strikes rapidly whereafter the lamp FL operates in conventional manner with current supplied via ballast impedance C1, L. After the lamp has struck the lamp conducts bidirectionally so that accumulation of charge on capacitor C1 during successive cycles no longer occurs. Furthermore the maximum voltage across the lamp is too low to cause the zener diode ZD to break down so that negligible heater current flows through electrodes H1 and H2 via thyristor TH in the running condition. The circuit components connected between terminals O2 and O3 apart from capacitor C3 thus become inoperative after the lamp has struck.

The components R1, R2 and C2 operate in conventional manner to shape the firing pulse supplied to the thyristor TH.

In one particular embodiment of the circuit for operating a 125 watt 8 foot fluorescent lamp from a 240 volt 50 Hz supply, details of the circuit are as follows:

| | |
|---|---|
| Capacitor C1 | 7.3 microfarads |
| Capacitor C2 | 0.47 microfarad |
| Capacitor C3 | 0.022 microfarad |
| Capacitor C4 | 0.1 microfarad |
| Resistor R1 | 22 kilohms |
| Resistor R2 | 100 ohms |
| Inductor L | 0.55 henries |
| Thyristor TH | TL5003 |
| Zener diode ZD | 480–550 volt breakdown |

Figure 5:
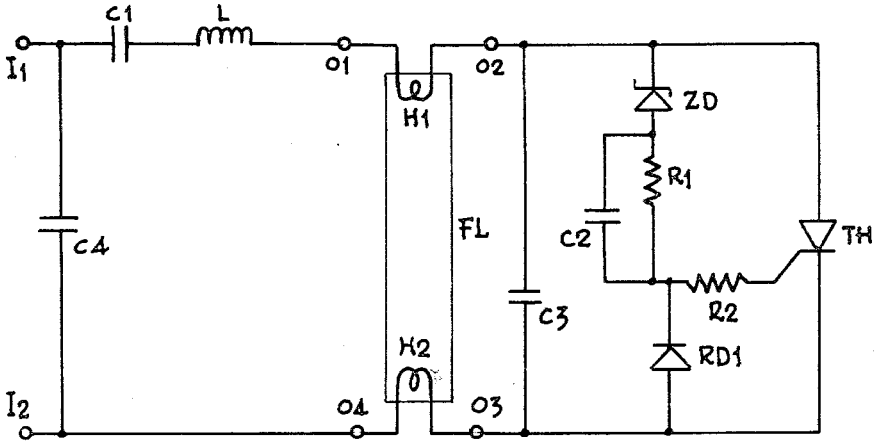
FIGS. 5, 6 and 7 are schematic diagrams illustrating three further circuit arrangements.

Referring now to FIG. 5, the second arrangement to be described is similar to that shown in FIG. 1 except that a rectifying diode RD1 is connected between the terminal O3 and the junction of resistors R1 and R2, the rectifier RD1 being poled in corresponding manner to zener diode ZD. The diode RD1 effectively by-passes components R2 and the gate resistance of thyristor TH, thereby reducing the impedance of the unidirectional current path via which capacitor C1 charges during starting. The charging rate of capacitor C1 and hence the repetition rate of the current pulses supplied to heater electrodes H1 and H2 are thereby increased, thus optimising lamp life.

Figure 6:
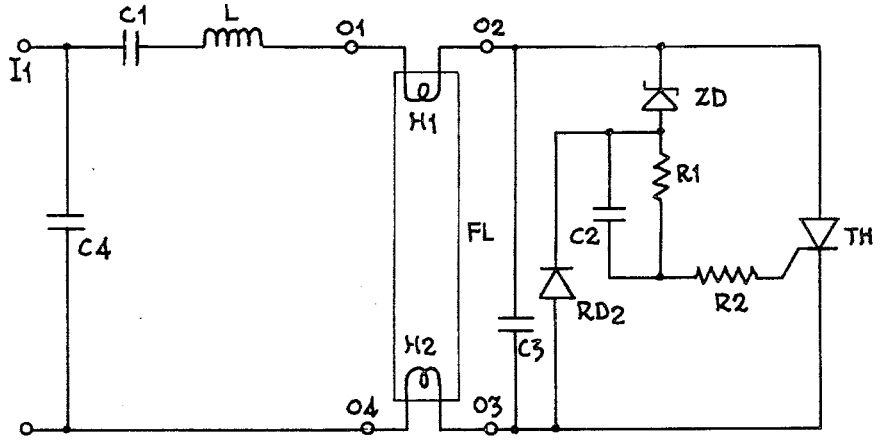

As shown in FIG. 6 the repetition rate of the current pulses may be further increased by connecting a rectifier RD2 between the terminal O3 and the junction of zener diode ZD and resistor R1, the components R1 and C2 then also being by-passed.

It will be appreciated that the reverse breakdown voltages of rectifiers RD1 and RD2 must be sufficiently high for these components not to break down when zener diode ZD breaks down.

Figure 7:
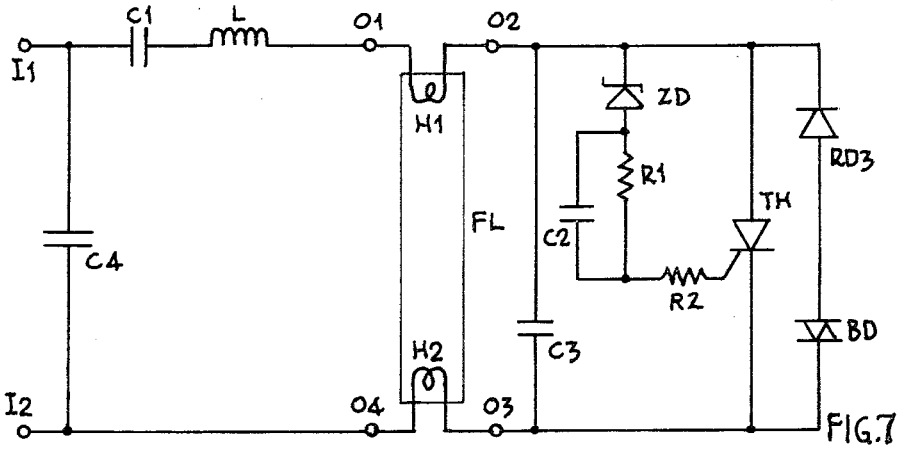

In the fourth arrangement shown in FIG. 7 the heater electrode pulse repetition rate is similarly increased by connecting a rectifier RD3 across the main electrodes of thyristor TH, the rectifier RD3 being poled in the reverse direction to the thyristor TH. The zener diode ZD is then also by-passed so that the unidirectional conducting path via which capacitor C1 is charged comprises heater electrodes H1 and H2, rectifier RD3 and inductance L.

A voltage breakdown device BD, for example a diac, is preferably connected in series with rectifier RD3 to prevent the passage of current through the rectifier RD3 after the lamp has struck. Alternatively, the rectifier RD3 may be a breakover diode, i.e. a diode which becomes conducting in the forward direction only if the applied voltage exceeds a predetermined value, and the breakdown device BD omitted. It will be appreciated that the reverse breakdown voltage of the rectifier RD3 must be sufficiently high for it not to break down before zener diode ZD.

It will be understood that other circuit arrangements in accordance with the invention may differ appreciably from those described above by way of example. Thus, whilst in the arrangement of FIGS. 1, 5 and 6 where the voltage breakdown device ZD in the gate lead of thyristor TH also forms part of the unidirectional charging path for capacitor C1, the breakdown device is suitably a zener diode. In the arrangement of FIG. 7, however, the zener diode ZD could conveniently be replaced by a simple voltage breakdown device.

It is further pointed out that the invention may find application with lamps having electrodes which require to be heated during starting other than fluorescent lamps, e.g. low pressure sodium lamps.

I claim:

1. An electric discharge lamp circuit arrangement comprising: a pair of terminals for connection to an alternating current supply; a ballast impedance comprising a capacitance connected between one of said terminals and one of a pair of main discharge electrodes of the lamp; a connection between the other of said terminals and the other of said main electrodes; heating means for at least one of said main electrodes a controllable switching device connected with the lamp to provide a current path between said pair of terminals comprising, in series, said capacitance, said heating means and said switching device; and a voltage breakdown device connected between the control electrode and a main electrode of said switching device; the voltage breakdown device being a reverse breakdown rectifying device so as to provide a unidirectional current conducting path whereby said capacitance charges from said supply while said switching device is open in a sense such as to bias said breakdown device towards breakdown.

2. A circuit arrangement according to claim 1 wherein said unidirectional conducting path extends through the switching device between its control electrode and one of its main electrodes.

3. A circuit arrangement according to claim 1 wherein said unidirectional conducting path extends through a rectifier which is connected in series with said voltage breakdown device and which by-passes a path through said switching device between its control electrode and one of its main electrodes.

4. A circuit arrangement according to claim 3 wherein said voltage breakdown device is connected with the control electrode of the switching device via a resistance connected in parallel with a capacitor and the rectifier is connected to the junction of said resistance and the breakdown device.

5. A circuit arrangement according to claim 4 wherein said voltage breakdown device is connected to said switching device via two resistances in series, one of which is connected in parallel with a capacitance, and said rectifier is connected to the junction between said resistances.

6. An electric discharge lamp circuit arrangement comprising: a pair of terminals for connection to an alternating current supply; a ballast impedance comprising a capacitance connected between one of said terminals and one of a pair of main discharge electrodes of the lamp; a connection between the other of said terminals and the other of said main electrodes; heating means for at least one of said main electrodes; a controllable switching device connected with the lamp to provide a current path between said pair of terminals comprising, in series, said capacitance, said heating means and said switching device; a voltage breakdown device connected between the control electrode and a main electrode of said switching device; and a rectifier connected between the main electrodes of the switching device so as to provide a unidirectional conducting path whereby said capacitance charges from supply while said switching device is open in a sense such as to bias said voltage breakdown device towards breakdown.

7. A circuit arrangement according to claim 6 wherein said rectifier is connected in series with a further voltage breakdown device whose breakdown voltage is such that the unidirectional conducting path becomes inoperative when the lamp has struck.

8. A circuit arrangement according to claim 6 wherein said voltage breakdown device has a breakdown voltage greater than the peak voltage of the supply.

9. A circuit arrangement according to claim 6 wherein said ballast impedance includes an inductance connected in series with said capacitance.

* * * * *